US005977915A

United States Patent [19]

Bergstedt et al.

[11] Patent Number: 5,977,915

[45] **Date of Patent: *Nov. 2, 1999**

[54] MICROSTRIP STRUCTURE

[75] Inventors: Leif Bergstedt, Sjömarken; Per Ligander, Göteborg, both of Sweden

[73] Assignee: Telefonaktiebolaget LM Ericsson, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/104,328

[22] Filed: Jun. 25, 1998

[30] Foreign Application Priority Data

Jun. 27, 1997 [SE] Sweden ..... 9702490

[51] Int. Cl.[6] ..... H01Q 1/38

[52] U.S. Cl. ..... 343/700 MS; 343/846; 343/238

[58] Field of Search ..... 343/700 MS, 846, 343/847, 848, 872; 333/236, 238

[56] References Cited

U.S. PATENT DOCUMENTS

| | | | |
|---|---|---|---|
| 3,904,997 | 9/1975 | Stinehelfer, Sr. . | |
| 4,210,885 | 7/1980 | Ho . | |
| 4,623,893 | 11/1986 | Sabban | 343/700 MS |
| 4,651,159 | 3/1987 | Ness | 343/700 MS |
| 4,903,033 | 2/1990 | Tsao et al. | 343/700 MS |
| 5,241,321 | 8/1993 | Tsao | 343/700 MS |
| 5,319,378 | 6/1994 | Nalbandian et al. | 343/700 MS |
| 5,355,143 | 10/1994 | Zurcher | 343/700 MS |
| 5,471,181 | 11/1995 | Park . | |
| 5,477,231 | 12/1995 | Medard | 343/700 MS |
| 5,532,643 | 7/1996 | Kuffner et al. . | |
| 5,760,744 | 6/1998 | Sauer | 343/700 MS |

FOREIGN PATENT DOCUMENTS 0 207 029 12/1986 European Pat. Off. .

OTHER PUBLICATIONS

Koul, S., "Passive Components in Inverted Microstrip and Suspended Microstrip Configurations", IEEE MTT–S Digest, pp. 412–414, 1983.

Tomar, R., "Effects of Manufacturing Tolerances on The Electrical Performance of Suspended and Inverted Microstrip Lines", Plenum Publishing Corporation, pp. 807–829, Apr. 23, 1985.

*Primary Examiner*—Don Wong
*Assistant Examiner*—Tan Ho
*Attorney, Agent, or Firm*—Burns, Doane, Swecker & Mathis, L.L.P.

[57] ABSTRACT

An environmentally compatible microstrip structure for electromagnetic signals in the microwave frequency range and higher. The microstrip structure according to the invention comprises at least two dielectric bodies made of an inorganic non-metallic material. Conductors of the microstrip structure are disposed on a first dielectric body. The ground plane of the microstrip structure is disposed on a second dielectric body. The dielectric bodies are so oriented that the second dielectric is between the at least one conductor and the ground plane while the first dielectric body is not. At least one cavitity is formed in the second dielectric body around at least one of the conductors to thereby create a composite dielectric comprising gas/air/vacuum of the cavity and the second dielectric body. The composite dielectric giving the microstrip structure adequate performance with dielectrically poor but environmentally compatible dielectric materials forming the dielectric bodies.

29 Claims, 2 Drawing Sheets

MICROSTRIP STRUCTURE

BACKGROUND

The present invention relates generally to a microstrip structure for electromagnetic signals in the microwave frequency range and higher, and more specifically to a microstrip distribution network and/or microstrip antenna, for example a base station antenna for a mobile telephone/communication system.

Microstrip antennas with microstrip distribution networks are traditionally manufactured in the form of boards in a dielectric material made from fibre glass epoxy, fibre glass reinforced PTFE (PTFE—Polytetraflouroethylene—teflon), or the like. These types of dielectrics are usually used because they commonly also act as a carrier for the ground plane and the relevant conductors. From an electrical point of view it would be preferable to have air or vacuum as a dielectric, but that would make mounting of a ground plane at a predetermined and fixed distance from conductors extremely difficult and expensive, if at all possible. Therefore the industry traditionally uses substrates made of fibre glass epoxy, fibre glass reinforced PTFE, or the like, as a compromise between different mechanical and electrical parameters. These dielectrics/carriers have in common that they are made of organic materials which often comprise flourides and/or anti-flame protection with bromides due to a low flame point of the materials. A problem with these dielectrics/ carriers is that they do burn even though they are treated with environmentally unfriendly anti-flame protection. Bromides and/or flourides can be released into the environment when the dielectrics burn. Flourides and bromides are considered to be extremely environmentally unfriendly. Due to the large number of base station antennas in mobile telephone networks, large amounts of bromides and/or flourides can be released into the environment when these antennas are destructed due to replacement or a fire.

SUMMARY

An object of the invention is to provide a microstrip structure which allows environmentally compatible materials, such as silica based glasses or ceramic materials, to be used as dielectrics while still having a low electrical loss.

Another object of the invention is to provide a microstrip distribution network and/or microstrip antenna with a low electrical loss which can be recycled, and disposed of, in a simple and environmentally safe manner.

A further object of the invention is to provide a microstrip distribution network and/or microstrip antenna with a low electrical loss using, as dielectrics, inorganic non-metallic materials normally unsuited for use as dielectric materials.

The above-mentioned objectives are achieved in accordance with the invention by an environmentally friendly/compatible microstrip structure for electromagnetic signals in the microwave frequency range and higher. The structure of the microstrip according to the invention comprises at least two dielectric bodies made from an inorganic non-metallic material such as a ceramic material, preferably silica based glass. The at least one conductor of the microstrip structure is disposed on a first dielectric body. The at least one conductor is preferably acting as a feeder possibly in a distribution network. The ground plane of the microstrip structure is disposed on a second dielectric body. The first and second dielectric bodies being so oriented that the second dielectric is between the at least one conductor and the ground plane while the first dielectric body is not between the at least one conductor and the ground plane. At least one cavity is formed in the second dielectric body around at least one and preferably each of the at least one conductor to thereby create a composite dielectric comprising gas/air/vacuum of the cavity and the second dielectric body. The composite dielectric giving the microstrip structure adequate performance with dielectrically poor but environmentally compatible dielectric materials forming the first and second dielectric bodies.

The aforementioned objectives are also achieved according to the invention by a microstrip structure for electromagnetic signals in the microwave frequency range and higher. The microstrip structure comprises a ground plane arranged at a predetermined distance from at least one conductor. The at least one conductor has a first side towards the ground plane and a second side away from the ground plane. The microstrip structure also comprises a first and a second dielectric body. The first dielectric body is formed from an inorganic non-metallic material, preferably silica based glass. It acts as a first carrier onto which first dielectric body the at least one conductor is disposed with the second side of the at least one conductor towards the first dielectric body. The second dielectric body is also formed from an inorganic non-metallic material. It acts as a second carrier onto which second dielectric body the ground plane is disposed. The second dielectric body being shaped and disposed inbetween the ground plane and the at least one conductor. It is disposed in such a way that a cavity is formed along the first side of at least one and preferably each of the at least one conductor and between the first side of the at least one conductor and the second dielectric body. Thereby the cavity forms a composite dielectric with the second dielectric body. Whereby a microstrip arrangement is formed which is disposable in an environmentally compatible way.

Preferably the first and second dielectric bodies can be connected/attached to each other in such a way as to form a sandwich microstrip structure. The second dielectric body can also, in some embodiments, preferably comprise a first and a second layer which are attached to each other. Each layer is preferably formed by an inorganic non-metallic material. The ground plane is preferably disposed on the first layer and the second layer preferably forms the at least one cavity along the at least one conductor.

It is preferable that the inorganic non-metallic material forming the first and second dielectric bodies is silica based glass. In some embodiments the at least one conductor comprises a first conductor layer and a second conductor layer. The first conductor layer comprises a conductive paste disposed on the first dielectric body and the second conductive layer comprises a plated metal disposed on the first conductive layer. This enables cheap and efficient screen transfer of the conductors while still providing electrically efficient conductors due to the plated metal layer. In the frequency ranges within which microstrip structures function, basically all conductors suffer from skin-effect. The electrically higher quality plated metal will carry the bulk of the current through the conductor.

In some embodiments it is an advantage that the microstrip structure further can comprise at least one passive and/or at least one active electronic component arranged within the at least one cavity in connection with the at least one conductor. The microstrip structure formed is preferably a microstrip distribution network and/or a microstrip antenna. The at least one cavity along the at least one conductor is either preferably substantially filled with air or the cavity is substantially a gas evacuated cavity.

The aforementioned objectives are also achieved by a microstrip antenna for reception and transmission of electromagnetic signals in the microwave frequency range and higher. The microstrip antenna comprises a ground plane arranged at a predetermined distance from at least one antenna feed conductor having a first side towards the ground plane and a second side away from the ground plane. The microstrip antenna also comprises a first and a second dielectric body. The first dielectric body is formed from an inorganic non-metallic material. It also acts as a first carrier onto which first dielectric body the at least one antenna feed conductor is disposed with the second side of the at least one antenna feed conductor towards the first dielectric body. The second dielectric body is also formed from an inorganic non-metallic material acting as a second carrier. The ground plane is disposed onto the second dielectric body. The second dielectric body is shaped and disposed inbetween the ground plane and the at least one antenna feed conductor in such a way that a cavity is formed along the first side of at least one and preferably each of the at least one antenna feed conductors and between the first side of the at least one antenna feed conductor and the second dielectric body to thereby form a composite dielectric with the second dielectric body. This forms a microstrip antenna which is disposable in an environmentally compatible way.

It is preferable that the microstrip antenna is an aperture coupled microstrip patch antenna and that the microstrip antenna further comprises at least one patch arranged at a predetermined distance from the ground plane. Preferably a third dielectric body is also comprised in the microstrip antenna. The third dielectric body is also formed from an inorganic non-metallic material. The third dielectric body acting as a third carrier onto which third dielectric body the at least one patch is disposed.

In some embodiments it is preferable that the at least one conductor comprises a first conductor layer and a second conductor layer. The first conductor layer comprises a conductive paste disposed on the first dielectric body. The second conductive layer comprises a plated metal disposed on the first conductive layer.

It can be of advantage in some embodiments that the microstrip antenna further comprises at least one passive and/or active electronic component arranged within the at least one cavity in connection with the at least one antenna feed conductor.

It is mostly preferable that the first and second dielectric bodies are attached to each other in such a way as to form a sandwich microstrip structure of the microstrip antenna.

In some embodiments it can be of advantage that the second dielectric body comprises a first and a second layer being attached to each other, each layer being formed by an inorganic non-metallic material. The ground plane is then disposed on the first layer. The second layer forms the at least one cavity along the at least one antenna feed conductor. Preferably the first layer forms the "roof" of the cavity while the second layer forms the "walls".

It is preferable that the inorganic non-metallic material forming the first, second, and third dielectric bodies is silica based glass. The at least one cavity along the at least one conductor is either substantially filled with air or the at least one cavity along the at least one conductor is substantially a gas evacuated cavity.

The aforementioned objectives are also achieved by a microstrip structure formed as a microstrip distribution network and a microstrip antenna for reception and transmission of electromagnetic signals in the microwave frequency range and higher. The microstrip structure comprises a ground plane arranged at a predetermined distance from at least one conductor of the microstrip distribution network. The at least one conductor has a first side towards the ground plane and a second side away from the ground plane. The microstrip structure also comprises a first and a second dielectric body. The first dielectric body is formed from a ceramic material, preferably silica based glass. The first dielectric material acts as a first carrier onto which first dielectric body the at least one conductor of the microstrip distribution network is disposed with the second side of the at least one conductor of the distribution network towards the first dielectric body. The second dielectric body is formed from a ceramic material, preferably silica based glass. The second dielectric material acts as a second carrier onto which second dielectric body the ground plane is disposed. The second dielectric body is shaped and disposed inbetween the ground plane and the at least one conductor of the microstrip distribution network in such a way that a cavity is formed along the first side of at least one and preferably each of the at least one conductor of the microstrip distribution network and between the first side of the at least one conductor of the microstrip distribution network and the second dielectric body to thereby form a composite dielectric with the second dielectric body. A microstrip distribution network and microstrip antenna arrangement is thus formed which is disposable in an environmentally compatible way.

It is preferable that the microstrip antenna is an aperture coupled microstrip patch antenna and that the microstrip structure further comprises at least one patch arranged at a predetermined distance from the ground plane and a third dielectric body formed from a ceramic material, preferably silica based glass. The third dielectric acting as a third carrier onto which third dielectric body the at least one patch is disposed.

The first and second dielectric bodies are preferably attached to each other in such a way as to form a sandwich microstrip distribution network structure of the microstrip structure. It is also preferable in some embodiments that the second dielectric body comprises a first and a second layer being attached to each other, each layer being formed by a ceramic material, preferably silica based glass. The ground plane is then preferably disposed on the first layer and the second layer forms the at least one cavity along the at least one conductor of the distribution network.

In some embodiments the at least one conductor of the microstrip distribution network comprises a first conductor layer and a second conductor layer. The first conductor layer comprises a conductive paste disposed on the first dielectric body and the second conductive layer comprises a plated metal disposed on the first conductive layer. It can be of advantage, in some embodiments, that the microstrip structure further comprises at least one passive and/or active electronic component arranged within the cavity in connection with the at least one conductor of the microstrip distribution network.

By providing a microstrip structure comprising two dielectric bodies made from inorganic non-metallic materials such as ceramics or silica based glass, many advantages over prior art microstrip structures are obtained. Examples of ceramic materials that are suitable for use with the invention are, apart from silica based glass, electrical porcelains, alumina ceramics $Al_2O_3$, or low temperature cofired ceramics (LTCC). The microstrip structure according to the invention has a low environmental impact during manufacture, use, and eventually recycling/destruction.

Ceramics and thus also silica based glass require a low energy consumption during manufacture. The environmentally compatible microstrip structure uses cheap and readily available materials such as silica based glass as dielectrics. As a hollow space, a cavity, is formed between at least one conductor acting as a feeder and the ground plane, additional active and/or passive electronics can be mounted in an environmentally protected place, for example, close to an antenna. The dielectrics are stiff which ensure excellent carrier characteristics. The stiffness of the dielectrics ensure that they can provide high accuracy in the predetermined distances between conductors and ground plane and also in addition, in some embodiments, radiating elements such as patches. In certain embodiments of the invention the first and second dielectric bodies are attached to each other in such a way as to form a sandwich microstrip structure thereby providing the predetermined distances with even higher accuracy and smaller production and operational variations. The microstrip structure according to the invention provides an environmentally compatible microstrip arrangement using dielectrically poor (dielectric constants around 6 to 8) but environmentally compatible materials. Even with ordinary "window-glass" quality silica based glass making the dielectric bodies an adequate, and to prior art microstrip structures comparable performance, is obtained. The structure in combination with the use of poor dielectric bodies is very advantageous, by having a cavity acting as a dielectric in direct contact with a conductor, low losses are obtained where there is a very dense/tight field, and by having, just on the ground plane, a layer of poor dielectrica, the sparse field close to the ground plane is advantageously bound to the ground plane.

BRIEF DESCRIPTION OF THE DRAWINGS

The invention will now be described in more detail for explanatory, and in no sense limiting, purposes, with reference to the following figures, in which.

DETAILED DESCRIPTION

In order to clarify the system according to the invention, some examples of its use will now be described in connection with FIGS. 1 to 7.

Figure 1:
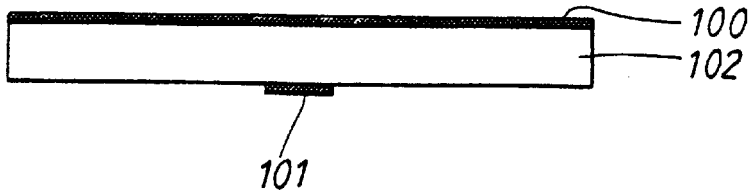
Prior Art FIG. 1
FIG. 1 shows a prior art microstrip structure.

FIG. 1 shows a cross section of a prior-art microstrip structure. Onto a dielectric 102, which also acts as a carrier, one or more conductors 101 are disposed on a first side and a ground plane 100 disposed on a second side. Traditionally the dielectric 102 is made of fibre glass epoxy, fibre glass reinforced teflon, PTFE, or the like as a trade off between dielectric and mechanical properties. Silica based glass or other inorganic non-metallic materials are often brittle and have extremely poor dielectrical characteristics (dielectric constants around 7), they are therefore generally considered as unsuitable for microstrip structures, especially microstrip structures with dimensions that a microstrip antenna for mobile telephone base station has. If the dielectric/carrier 102 of the microstrip structure according to FIG. 1 was made of silica based glass or a ceramic material then the microstrip structure would be practically unusable for electromagnetic signals in the microwave range and higher.

Figure 2:
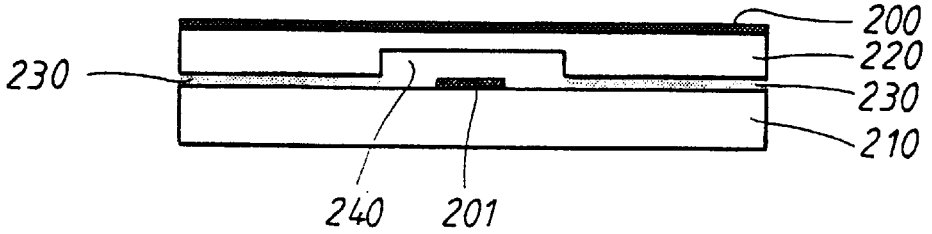
FIG. 2 shows a first embodiment of a microstrip structure according to the invention.

FIG. 2 shows a cross section of a first embodiment of a microstrip structure according to the invention. The microstrip structure according to the invention comprises at least a first dielectric body 210 and a second dielectric body 220, which bodies also function as carriers. The materials used for making the dielectric bodies of the microstrip structures according to the invention and described in this description are all inorganic non-metallic materials such as ceramics, preferably silica based glass of different qualities.

The first dielectric body 210 can typically be in the order of 2 mm thick and the second dielectric body 220 can be in the order of 1.6 mm thick. One or more conductors 201 acting as feeders are disposed on the first dielectric 210 and a ground plane 200 is disposed on the second dielectric 220. The conductors 201 can advantageously be screen printed onto the first dielectric body 210 with a conductive paste, a metal plated onto the first dielectric body 210, or constructed in two layers with a combination of screen printing with a conductive paste onto the first dielectric body 210 in a first layer and metal plating on top of the first layer in a second layer.

The ground plane 200 can comprise one or more slots, to thereby form a microstrip slot antenna or if patches are also provided at an appropriate distance from the ground plane 200, a microstrip aperture coupled patch antenna.

The dielectric bodies in the microstrip structure are arranged in the order: the first dielectric body 210, conductors 201, the second dielectric body 220, and the ground plane 200. In this embodiment the first dielectric body 210 and the second dielectric body 220 are attached to each other, preferably with a glue joint 230, to thereby form a sandwich microstrip structure. A typical glue joint 230 can be in the order of 5 to 30 $\mu$m thick. A hollow space 240, a cavity, is formed around the conductors 201 and thus in this embodiment the cavities are formed in the second dielectric body 220. The cavity 240 is typically in the order of 0.5 to 1 mm high and can with advantage be made by die-casting the second dielectric body 220. Thereby a composite dielectric is formed by the cavity 240 and part of the second dielectric body 220 above the conductors 201 and importantly with the cavity 240 being closest to the conductors 201 where the electromagnetic fields are the most dense thereby providing low losses. The microstrip structure therefore enables excellent transmission properties to b e attained even though dielectrically poor materials, such as silica based glass, are used for the dielectrical bodies.

Figure 3:
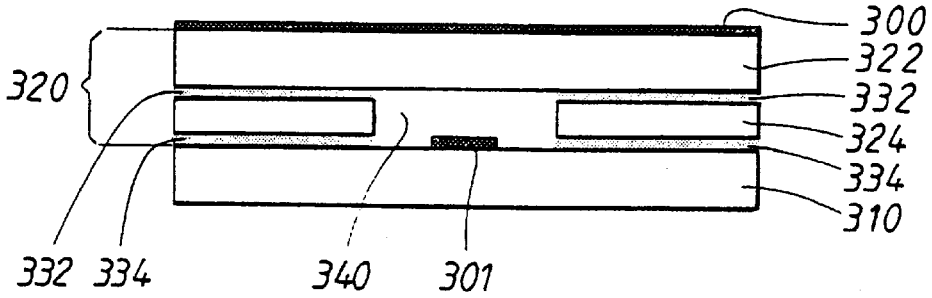
FIG. 3 shows a second embodiment of a microstrip structure according to the invention.

FIG. 3 shows in cross section a second embodiment of a microstrip structure according to the invention. In this second embodiment the second dielectric body 320 comprises a first whole layer 322 and a second cut layer 324. A conductor 301 is disposed on the first dielectric body 310. A ground plane 300 is disposed on the first layer 322 of the second dielectric body. A cavity 340 is formed by the material which is absent, preferably cut away, from the second layer 324 of the second dielectric body 320 between the conductor 301 and the first layer 322 of the second dielectric body 320. The first 322 and second 324 layer of the second dielectric body 320 are advantageously attached to each other by a glue joint 332. The first dielectric body 310 is advantageoulsy attached to the second dielectric body 320 by means of a glue joint 334 between the first dielectric body 310 and the second layer 324 of the second dielectric body 320. The second embodiment of the invention thus also forms a sandwich microstrip structure.

Figure 4:
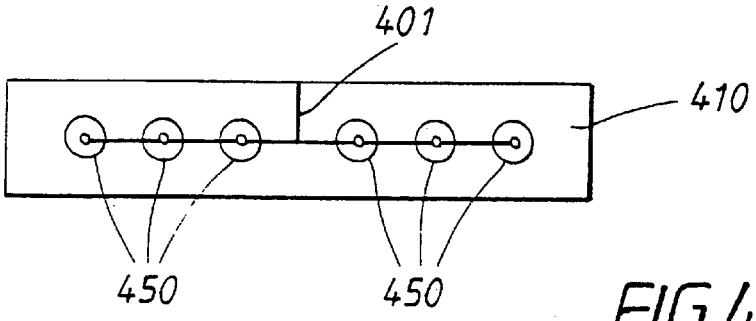
FIG. 4 shows a plane view of a microstrip distribution network to a microstrip antenna according to the invention.

FIG. 4 shows a plane view of a microstrip distribution network to a microstrip antenna according to the invention. The conductors 401 of the distribution network are disposed onto a first dielectric body 410. The conductors 401 distribute electromagnetic signals in the microwave frequency range and higher to and/or from the antenna cells 450. A typical base station antenna for a mobile telephone system is in the magnitude of 150 to 250 mm wide and 600 to 2500 mm long. The exact appearance of the distribution network and the number of and distance between the antenna cells 450 depends on many different factors such as desired power range, frequency range, desired antenna lobes etc.

Figure 5:
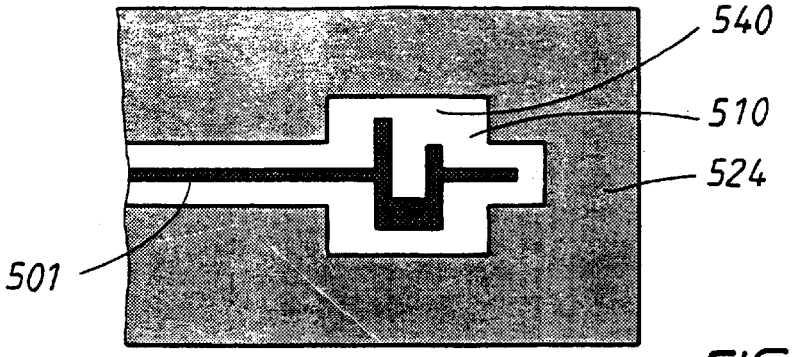
FIG. 5 shows a plane view of a detail of a microstrip distribution network according to the invention.

FIG. 5 shows a plane view of a detail of a microstrip distribution network according to the invention. This detail can for example come from a microstrip structure according to the invention of the type described in conjunction with FIG. 3. The plane view shown is between a first layer and a second layer 524 of a second dielectric body. Here is shown a conductor 501 that is disposed onto a first dielectric body 510. A cavity 540 is formed by the limitations of the first dielectric body 510, the conductor, a second layer 524 of a second dielectric body, and a first layer of the second dielectric body, which first layer is not shown. The cavity can be shaped and formed in such a way that passive and/or active electronics can fit into the cavity. Power conductors to active electronics can have their own cavities to thereby ensure that the preferred glue joints are of uniform thickness.

Figure 6:
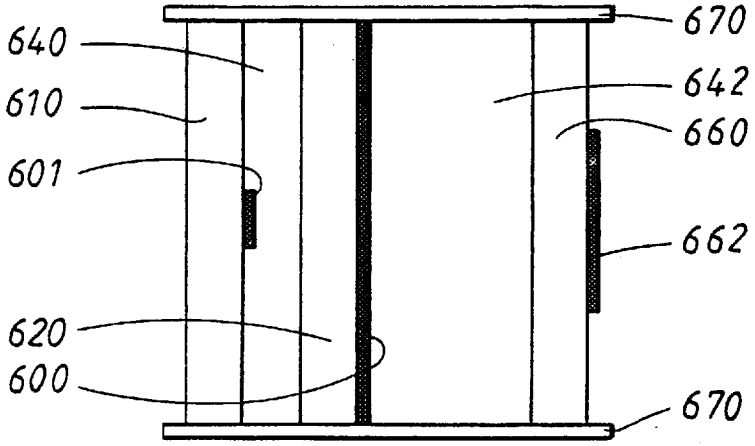
FIG. 6 shows a first embodiment of a microstrip antenna according to the invention.

FIG. 6 shows a cross section of a first embodiment of a microstrip antenna with aperture coupled patches and a possible microstrip distribution network according to the invention. The cross section is such that an aperture, a slot, in a ground plane 600 is not shown. Three dielectric bodies 610, 620, 660 are held at predetermined distances from each other by a frame 670 into which the dielectric bodies 610, 620, 660 are mounted. Conductors 601 are disposed on the first dielectric body 610. The ground plane 600 is disposed on the second dielectric body and one or more patches 662 are disposed on the third dielectric body 660. A first hollow space 640, a cavity, is formed between the second dielectric body 620, the first dielectric body 610, the conductors 601, and the frame 670. The order in which units in this embodiment are arranged is: first dielectric body 610, conductors 601, first hollow space 640, second dielectric body 620, ground plane 600, a possible second hollow space 642, third dielectric body 660, and patches 662 (or vice versa). The order of the third dielectric body 660 and the patches 662 can advantageously be reversed.

Figure 7:
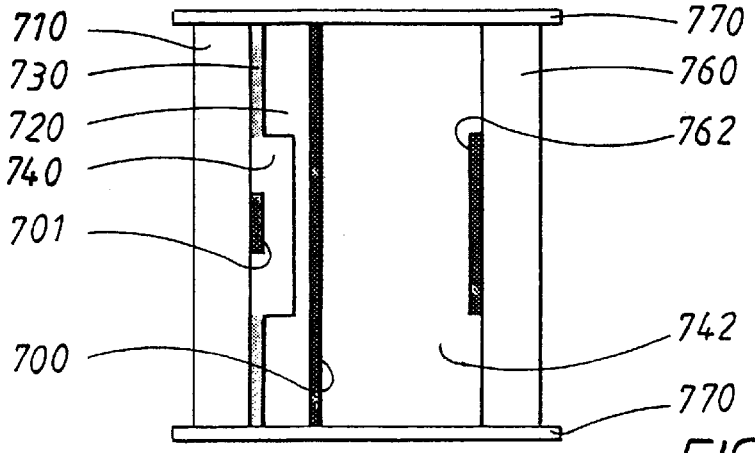
FIG. 7 shows a second embodiment of a microstrip antenna according to the invention.

FIG. 7 shows a cross section of a second embodiment of a microstrip antenna and possibly a microstrip distribution network, both according to the invention. A first dielectric body 710 is attached, preferably by a glue joint 730, to a second dielectric body 720 to thereby form a sandwich microstrip structure. A frame 770 holds the first and second dielectric bodies 710, 720 at a predetermined distance from a third dielectric body 760. At least one conductor 701 is disposed on the first dielectric body 710. A ground plane 700 is disposed on the second dielectric body 720 and at least one patch is disposed on the third dielectric body 760. A cavity 740 is formed in the second dielectric 720 in between the conductor 701 and the second dielectric body 720. The order in which units in this embodiment are arranged is: first dielectric body 710, conductor 701, cavity 740, second dielectric body 720, ground plane 700, a hollow space 742, patch 762, and third dielectric body 760 (or vice versa). The order of the third dielectric body 760 and the patch 762 can be reversed.

In summary, the invention can basically be described as an environmentally compatible microstrip arrangement using at least two dielectric bodies made from inorganic non-metallic materials such as silica based glass.

The invention is not limited to the embodiments described above but may be varied within the scope of the appended patent claims.

What is claimed is:

1. A microstrip structure for electromagnetic signals in the microwave frequency range and higher, which microstrip structure comprises a ground plane arranged at a predetermined distance from at least one conductor acting as a feeder having a first side towards the ground plane and a second side away from the ground plane, wherein the microstrip structure also comprises:

a first dielectric body formed from an inorganic non-metallic material acting as a first carrier onto which first dielectric body the at least one conductor is disposed with the second side of the at least one conductor towards the first dielectric body, a second dielectric body formed from an inorganic non-metallic material acting as a second carrier onto which second dielectric body the ground plane is disposed, the second dielectric body being shaped and disposed inbetween the ground plane and the at least one conductor in such a way that at least one cavity is formed along the first side of at least one of the at least one conductor and between the first side of the at least one conductor and the second dielectric body to thereby form a composite dielectric with the second dielectric body, whereby a microstrip is formed which is disposable in an environmentally compatible way.

2. The microstrip structure according to claim 1, wherein the first and second dielectric bodies are connected/attached to each other in such a way as to form a sandwich microstrip structure.

3. The microstrip structure according to claim 1, wherein the second dielectric body comprises a first and a second layer being attached to each other, each layer being formed by an inorganic non-metallic material.

4. The microstrip structure according to claim 3, wherein the ground plane is disposed on the first layer and that the second layer forms the at least one cavity along at least one of the at least one conductor.

5. The microstrip structure according to claim 1, wherein the inorganic non-metallic material forming the first and second dielectric bodies is silica based glass.

6. The microstrip structure according to claim 1, wherein the inorganic non-metallic material forming the first and second dielectric bodies is a ceramic belonging to the electrical porcelain group of ceramics.

7. The microstrip structure according to claim 1, wherein the at least one conductor comprises a first conductor layer and a second conductor layer where the first conductor layer comprises a conductive paste disposed on the first dielectric body and where the second conductive layer comprises a plated metal disposed on the first conductive layer.

8. The microstrip structure according to claim 1, wherein the microstrip structure further comprises at least one passive and/or active electronic component arranged within the at least one cavity in connection with the at least one conductor.

9. The microstrip structure according to claim 1, wherein the microstrip structure formed is a microstrip distribution network and a microstrip antenna.

10. The microstrip structure according to claim 1, wherein the at least one cavity along the at least one conductor is substantially filled with air.

11. The microstrip structure according to claim 1, wherein the at least one cavity along the at least one conductor substantially is a gas evacuated cavity.

12. A microstrip antenna for reception and transmission of electromagnetic signals in the microwave frequency range, which microstrip antenna comprises a ground plane arranged at a predetermined distance from at least one antenna feed conductor having a first side towards the ground plane and a second side away from the ground plane, wherein the microstrip antenna also comprises:

a first dielectric body formed from an inorganic non-metallic material acting as a first carrier onto which first dielectric body the at least one antenna feed conductor is disposed with the second side of the at least one antenna feed conductor towards the first dielectric body, a second dielectric body formed from an inorganic non-metallic material acting as a second carrier onto which second dielectric body the ground plane is disposed, the second dielectric body being shaped and disposed inbetween the ground plane and the at least one antenna feed conductor in such a way that at least one cavity is formed along the first side of at least one of the at least one antenna feed conductor and between the first side of the at least one antenna feed conductor and the second dielectric body to thereby form a composite dielectric with the second dielectric body, whereby a microstrip antenna is formed which is disposable in an environmentally compatible way.

13. The microstrip antenna according to claim 12, wherein the microstrip antenna is an aperture coupled microstrip patch antenna and that the microstrip antenna further comprises at least one patch arranged at a predetermined distance from the ground plane and a third dielectric body formed from an inorganic non-metallic material acting as a third carrier onto which third dielectric body the at least one patch is disposed.

14. The microstrip antenna according to claim 13, wherein the inorganic non-metallic material forming the first, second, and third dielectric bodies is silica based glass.

15. The microstrip antenna according to claim 13, wherein the inorganic non-metallic material forming the first, second, and third dielectric bodies is a ceramic belonging to the electrical porcelain group of ceramics.

16. The microstrip antenna according to claim 12, wherein the at least one antenna feed conductor comprises a first conductor layer and a second conductor layer where the first conductor layer comprises a conductive paste disposed on the first dielectric body and where the second conductive layer comprises a plated metal disposed on the first conductive layer.

17. The microstrip antenna according to claim 12, wherein the microstrip antenna further comprises at least one passive and/or active electronic component arranged within the at least one cavity in connection with the at least one antenna feed conductor.

18. The microstrip antenna according to claim 12, wherein the first and second dielectric bodies are attached to each other in such a way as to form a sandwich microstrip structure of the microstrip antenna.

19. The microstrip antenna according to claim 12, wherein the second dielectric body comprises a first and a second layer being attached to each other, each layer being formed by an inorganic non-metallic material.

20. The microstrip antenna according to claim 19, wherein the ground plane is disposed on the first layer and that the second layer forms the at least one cavity along the at least one antenna feed conductor.

21. The microstrip antenna according to claim 12, wherein the at least one cavity along the at least one antenna feed conductor is substantially filled with air.

22. The microstrip antenna according to claim 12, wherein the at least one cavity along the at least one antenna feed conductor is substantially a gas evacuated cavity.

23. A microstrip structure formed as a microstrip distribution network and a microstrip antenna for reception and transmission of electromagnetic signals in the microwave frequency range, which microstrip structure comprises a ground plane arranged at a predetermined distance from at least one conductor of the microstrip distribution network having a first side towards the ground plane and a second side away from the ground plane, wherein the microstrip structure also comprises:

a first dielectric body formed from a ceramic material, preferably silica based glass, acting as a first carrier onto which first dielectric body the at least one conductor of the microstrip distribution network is disposed with the second side of the at least one conductor of the distribution network towards the first dielectric body, a second dielectric body formed from a ceramic material, preferably silica based glass acting as a second carrier onto which second dielectric body the ground plane is disposed, the second dielectric body being shaped and disposed inbetween the ground plane and the at least one conductor of the microstrip distribution network in such a way that at least one cavity is formed along the first side of at least one of the at least one conductor of the microstrip distribution network and between the first side of the at least one conductor of the microstrip distribution network and the second dielectric body to thereby form a composite dielectric with the second dielectric body, whereby a microstrip structure is formed which is disposable in an environmentally safe way.

24. The microstrip structure according to claim 23, wherein the microstrip antenna is an aperture coupled microstrip patch antenna and that the microstrip structure further comprises at least one patch arranged at a predetermined distance from the ground plane and a third dielectric body formed from a ceramic material acting as a third carrier onto which third dielectric body the at least one patch is disposed.

25. The microstrip structure according to claim 23, wherein the first and second dielectric bodies are attached to each other in such a way as to form a sandwich microstrip distribution network structure of the microstrip structure.

26. The microstrip structure according to claim 23, wherein the second dielectric body comprises a first and a second layer being attached to each other, each layer being formed by a ceramic material.

27. The microstrip structure according to claim 26, wherein the ground plane is disposed on the first layer and that the second layer forms the at least one cavity along the at least one conductor of the distribution network.

28. The microstrip structure according to claim 23, wherein the at least one conductor of the microstrip distribution network comprises a first conductor layer and a second conductor layer where the first conductor layer comprises a conductive paste disposed on the first dielectric body and where the second conductive layer comprises a plated metal disposed on the first conductive layer.

29. The microstrip structure according to claim 23, wherein the microstrip structure further comprises at least one passive and/or active electronic component arranged within the cavity in connection with the at least one conductor of the microstrip distribution network.

* * * * *